United States Patent [19]

Provost

[11] Patent Number: 4,874,135

[45] Date of Patent: Oct. 17, 1989

[54] MILL THROAT FOR PULVERIZER

[76] Inventor: Robert S. Provost, Suite 283, 6393 Penn Ave., Pittsburgh, Pa. 15206

[21] Appl. No.: 290,377

[22] Filed: Dec. 29, 1988

[51] Int. Cl.[4] ..... B02C 15/06

[52] U.S. Cl. ..... 241/57; 241/103; 241/119; 241/121

[58] Field of Search ..... 241/117–121, 241/57, 103, 58, 60, 107, 109

[56] References Cited

U.S. PATENT DOCUMENTS

| | | | |
|---|---|---|---|
| 3,199,797 | 8/1965 | Eft et al. | 241/119 X |
| 4,264,041 | 4/1981 | Kitto, Jr. et al. | 241/121 X |
| 4,602,745 | 7/1986 | Maliszewski et al. | 241/119 |
| 4,721,258 | 1/1988 | Dougan et al. | 241/121 X |

*Primary Examiner*—Timothy V. Eley
*Attorney, Agent, or Firm*—Olin E. Williams

[57] ABSTRACT

In the vertically oriented generally cylindrical coal pulverizers that are widely employed to supply a coal-air dispersion to the combustion zones of boilers producing steam for the turbines of electric-power plants, forced-air requirements are reduced and coal fall-back and resultant coal fires are substantially eliminated by the novel throat ring of invention. A throat ring surrounds circumferentially the coal grinding assembly of each such pulverizer and contains a plurality of angularly disposed air channels through which air is forced upwardly into contact with pulverized coal thrust centrifugally from the said assembly causing the coal-air mixture to swirl upwardly to means directing the mixture to the said combustion zones. The air channels in the throat ring of invention are in effect of reduced cross-section and comprise a convex bevel of the outer-diameter wall of each channel from the said wall to the outer rim of the throat ring thus defining the exit port of each channel of an area equivalent to the cross-section of the air-channels of the throat ring which it replaces.

4 Claims, 3 Drawing Sheets

MILL THROAT FOR PULVERIZER

This invention relates to pulverizers designed to pulverize coal and to disperse the pulverized product in controlled proportion in air for delivery as fuel into the combustion zone of, in most cases, the boilers of a power plant. The invention relates more particularly to an improvement of means for dispersing the pulverized coal particles in air in those pulverizers of generally cylindrical configuration and central vertical axis which are widely employed in power plants.

Such pulverizers must meet heavy demands for low cost and large quantity production of electrical power, and consequently must supply pulverized coal in such amounts for example as 150,000 pounds per hour in the typical 60 ton mill. The pulverizer herein described has found wide acceptance in industry. Nevertheless the employment of such large volumes of coal particles and of forced air makes the cost and efficiency of all of the operating factors of the pulverizer of obvious concern.

It is an object of this invention to improve the efficiency of dispersion of coal particles in air so as to reduce the forced air requirement of a given pulverizer.

Another object of the invention is to reduce and substantially to eliminate the rejection of coal particles at the dispersion zone, commonly referred to as "coal dribble", i.e., the failure of some of the coal particles to be taken up by the forced air stream. Such coal particles fall to the bottom of the pulverizer, and can and do cause fires within the base of the pulverizer.

Yet another object of the invention is the provision of means to accomplish the foregoing objects by a drop-in retro-fit requiring no preparatory alteration of existing mills.

DETAILED DESCRIPTION OF THE DRAWINGS

Figure 1:
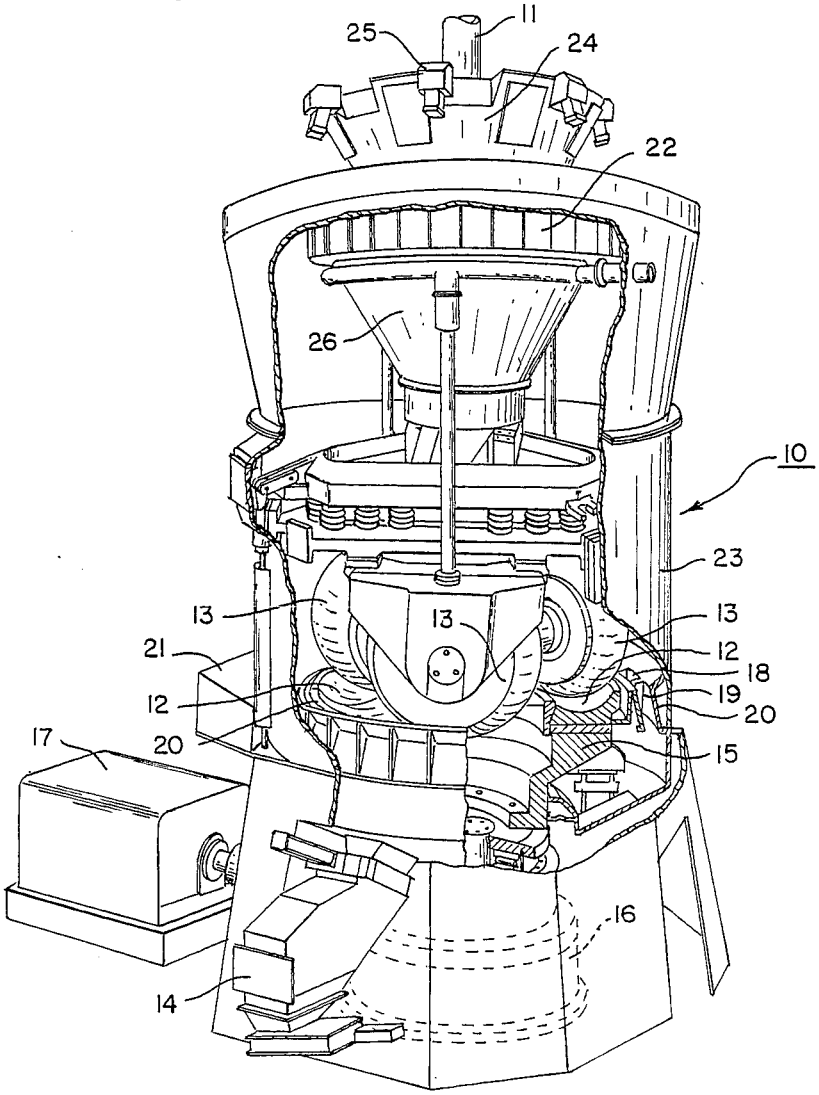
FIG. 1 is an elevational view of a coal pulverizer with parts broken away so as to show the functional relationship and operation of the various elements of the mill, and the location of the improved throat ring of invention.

With reference to FIG. 1, the entire figure is an elevational view of a coal pulverizer 10, with parts broken away. Raw coal is fed into the top of the pulverizer through raw-coal pipe 11 and descends in known manner to and upon trough-shaped grinding ring 12 which forms a revolving circular through in which revolve grinding wheels 13. A so-called "pyrites box" 14 receives mineral particles separated from the ground coal.

The grinding ring 12 having a base or yoke 15 is driven by conventional drive mechanism 16 and motor 17. The grinding ring revolves at high speeds and causes the spring-weighted grinding wheels to revolve in place and at high speed in the trough-shaped ring 12 and to crush the coal lying thereon. The pulverized coal is centrifugally thrust by the rapid revolution of the grinding ring 12 at a rate for example between about 1500 and 3000 pounds per minute across the exit ports 18 of the air channels 19 of the throat ring 20 which circumscribes the grinding ring 12. As shown in more detail in subsequent Figures of the drawings, the throat ring 20 concentrically surrounds the coal grinding assembly such that all of the pulverized coal passes over the throat ring.

Forced air is supplied through air inlet 21 to and through the air channels 19 of the fixed throat ring 20 at such rate of flow as to create a maximum air-coal flow of between 1500 and 3000 pounds per minute. The forced air imparts to the coal a swirling motion and carries the coal upward to the classifier louvre sections 22. The housing 23 of the pulverizer is protected from the abrasive action of the swirling coal particles by a ceramic tile lining, not shown. The coal-air mixture flows from the classifier louvre sections 22 to discharge turret 24, which comprises a plurality of feeder ports 25 to which are connected fuel pipes, not shown, leading to a combustion zone usually of a boiler or boilers of an electric-power plant. Large coal particles fall from the classifier assembly into classifier cone 26 from which they are discharged in known manner to the coal grinding assembly.

Figure 2:
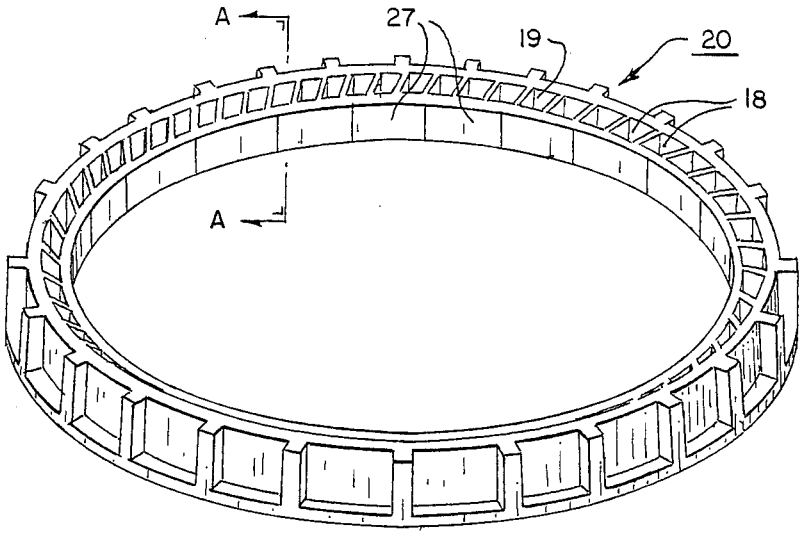
FIG. 2 is a perspective view of a throat ring showing the disposition of the air channels of the ring.

Referring to FIG. 2, the throat ring 20 consists of a plurality of regularly spaced arcuate segments 27. Each of the segments contains a plurality of air channels 19, for example, 2½ air channels per segment, having exit ports 18. The throat ring rests on a permanently installed assembly and air box or manifold, not shown, connected to the air inlet 21. The throat ring 20 is held in position by outer diameter bolts and an inner diameter air/seal ring, not shown.

Figure 3:
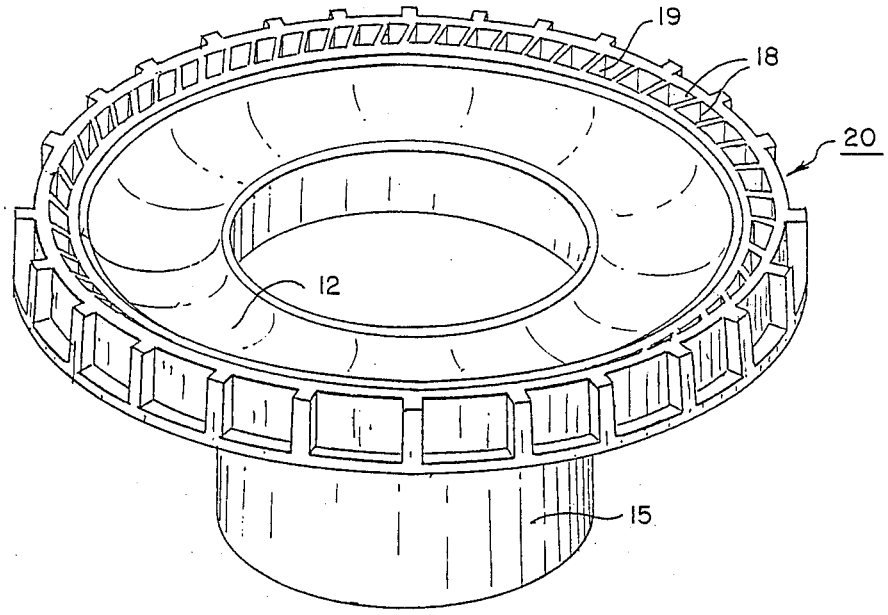
FIG. 3 is an elevational view showing the relationship of the said throat ring to grinding elements of the pulverizer.

In FIG. 3 the positional relationship of the rotating yoke 15 and grinding ring 12 to the encircling throat ring 20 is shown. Coal pulverized on the grinding ring 12 is thrust over the exit ports 18 of the channels 19.

Figure 4:
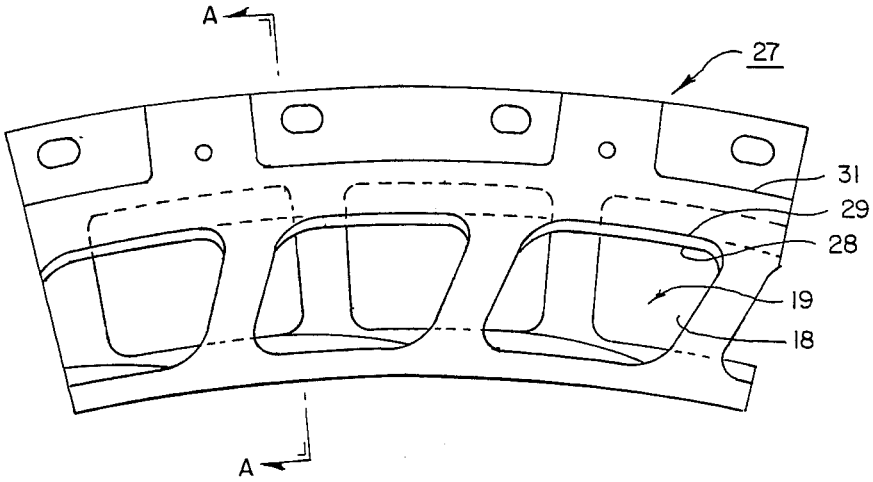
FIG. 4 is a plan view of a single segment of the throat ring of invention.

In FIG. 4 a plan view of a single segment 27 of the throat ring 20 shows the position and configuration of the air channels 19 in which dotted lines disclose the position of the respective air channels 19 at the bottom of the ring 20 in relation to the exit ports 18 of the ring, demonstrating how air emitted from the channels and horizontally thrust coal particles encountered at that point are given a vertical swirling motion.

Each of the channels 19 along its outer-diameter edge is curved outwardly from its vertical plane 28 defined by line 28 on the drawing to its juncture 29 with the surface 31 of the throat ring. It can be seen that the vertical wall or plane 28 of the outer-diameter of the channels 19 restricts the cross-section of each of the channels to less than the cross-sectional area of the exit ports 18 of the channels.

Figure 5:
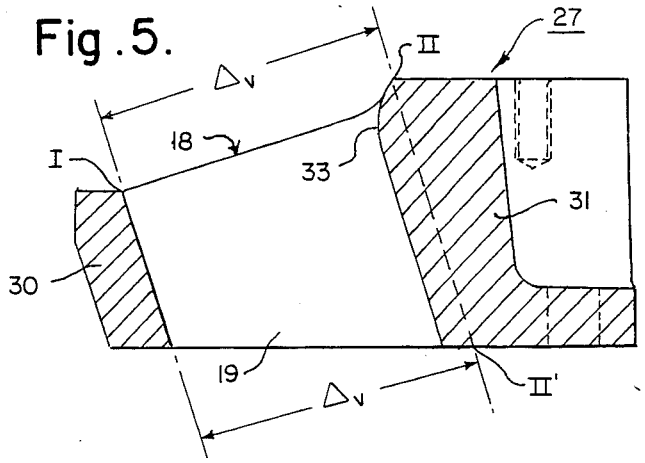
FIG. 5 is a vertical cross-section of a single channel section of the throat ring of invention.

FIG. 5, a cross-sectional elevational view of a single channel 19 of a segment 27 of the throat ring 20 taken along the line A—A of FIGS. 2 and 4 further illustrates the preferred embodiment of the throat ring of invention whereby the objects of the latter are obtained. The dimension from the point I on inner section 30 of the channel 19 to the highest point II on the outer-diameter section 31 defines the radial dimension of the exit port 18. The outer section 31 is so designed as to restrict the radial dimension of the channels 19 (or, in effect, the channel cross-section) by 7 to 16 percent of the radial dimension Δv of the exit port, as indicated on FIG. 5 by dotted line II—II. In this, the preferred embodiment of my improved throat ring, the outer exit port 18 and the radial dimension Δv is established by an arcuate convex bevel 33, of the outer diameter wall of the channel 19. The convex bevel 33 has an inner radius of between about 1 and 3 inches and preferably between 1½ and 2 inches.

Although in fact a separate casting, the novel throat ring of my invention is characterized by channels of which the exit port is enlarged along its outer diameter by a convex opening of the exit port so that the distance Δv between the inner and outer points I and II of the exit port is maintained equivalent to that dimension formerly considered the standard uniform cross-sectional length for throat rings of any given capacity and being in fact the radial dimension of the air channels of those throat rings which are replaced by the throat ring of invention.

Figure 6:
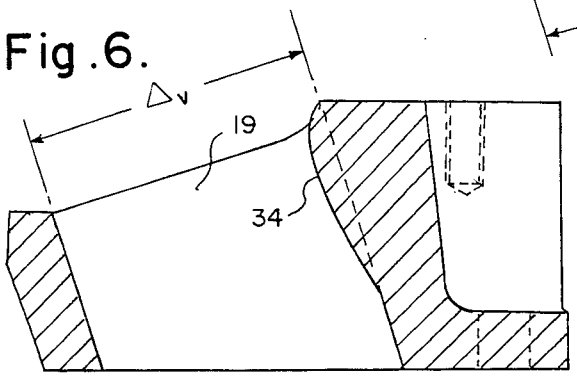
FIG. 6 is a vertical cross-section of a single channel section of an alternate throat ring of invention.

While the arcuate convex bevelled opening of the exit port as above described is preferred, a substantially equivalent effect can be obtained by shaping the outer diameter wall of each channel 19 as shown in FIG. 6. Here the channel passage is restricted by a convex outer channel wall 34 narrowing the passage from the standard opening of radial width Δv at the base of the channel 19 along the outer-diameter wall of the channel and by essentially a return to the dimension Δv at the exit port of the channel.

In a specific example of its operation, the throat ring of my invention was installed in a 55 ton coal pulverizer of Babcock and Wilcox manufacture providing the fuel for an electric power plant of major dimension. The throat ring segments consisted of castings of a 27% chromium white iron alloy of high martensitic nature with 4 to 7 percent moly added. The total exit port area of the throat ring was 5.36 square feet, equal to that of the replaced ring, the said exits being formed by an arcuate outer-diameter convex bevel having an inner radius of one and three quarter inches. The air channels were restricted to about 10–15 percent of that of the replaced throat ring. The coal pulverizer supplied about 150,000 pounds per hour of pulverized coal. The power demand for the forced-air supply to the pulverized coal was reduced by 10 to 15 percent and for the entire period of initial operation up to the present no substantial coal dribble has been observed and no coal fires have occurred.

It is suggested in possible explanation of the advantages contributed by the throat ring of invention that, while reducing the cross-sectional area of the air channels alone would increase the velocity of the air in the channels and presumably reduce the falling back, or dribble, of coal particles, the increased velocity of air required to strike the great mass of coal particles and convert their horizontal momentum to a vertical swirling motion (an energy demand greatly in excess of that required to force the air through the open channels) would put an unacceptable power demand on the forced air supply, and hence an unacceptable increased cost of operation. It has been found, however, that opening the exit ports of the throat ring in controlled manner by directing the air stream along the outward bevelled semi-parabolic face of the channel greatly alters and reduces the impact of the air against the horizontal stream of coal particles, a reduction in resistance to air flow which greatly exceeds the additional energy required to force air through channels of reduced cross-section. At the same time the air flowing at increased speed through the restricted air channels substantially eliminates or at least greatly reduces coal dribble.

What I claim is:

1. In a coal pulverizer of generally cylindrical shape and vertical central axis and having a mill assembly which thrusts pulverized coal centrifugally from the mill and a source of forced air to propel a mixture of the so-thrust coal and air vertically to classifier means and subsequently to a combustion zone; a throat ring surrounding the said mill the throat mill being uniformly composed of a plurality of angularly disposed vertical channels through which the air is upwardly passed, each said channel having an exit port over which pulverized coal is passed, each said exit port being of essentially greater cross-section than the cross-section of that remainder of each corresponding channel extending beneath the exit port and being formed by a convex outer diameter exit bevel coterminous with the upper surface of the throat ring.

2. The throat ring of claim 1 in which the said exit bevel has an inner radius of between about 1 and 3 inches terminating flush with the outer rim of the throat ring.

3. The throat ring of claim 2 in which the length of the said inner radius is between 1½ and 2 inches.

4. The throat ring of claim 1 in which the said ring consists of a plurality of radial sections of uniform configuration and that as assembled as a complete ring forms a flat base communicating with and resting on a permanently installed flat air box.

* * * * *